US009664458B2

(12) United States Patent
Lin

(10) Patent No.: US 9,664,458 B2
(45) Date of Patent: May 30, 2017

(54) SUPPORTING STRUCTURE FOR VAPOR CHAMBER

(71) Applicant: ASIA VITAL COMPONENTS CO., LTD., New Taipei (TW)

(72) Inventor: Sheng-Huang Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 208 days.

(21) Appl. No.: 14/583,105

(22) Filed: Dec. 25, 2014

(65) Prior Publication Data

US 2016/0187074 A1 Jun. 30, 2016

(51) Int. Cl.
*F28F 9/007* (2006.01)
*F28D 15/04* (2006.01)

(52) U.S. Cl.
CPC ..... *F28F 9/007* (2013.01); *F28D 15/046* (2013.01)

(58) Field of Classification Search
CPC ..... F28D 14/0233; F28D 14/046
USPC ..... 165/104.26
See application file for complete search history.

(56) References Cited

U.S. PATENT DOCUMENTS 6,827,134 B1 * 12/2004 Rightley et al. .... F28D 15/0233 165/104.21
7,770,631 B2 * 8/2010 Wang ..... F28D 15/0233 165/104.21
7,971,633 B2 * 7/2011 Moon et al. ..... H01L 23/427 165/104.26
8,534,348 B2 * 9/2013 Ohsawa et al. ..... B23P 15/26 165/104.26
2002/0020518 A1 * 2/2002 Li ..... F28D 15/0233 165/104.11
2004/0069460 A1 * 4/2004 Sasaki et al. ..... F28D 15/0241 165/104.26
2008/0210407 A1 * 9/2008 Kim et al. ..... F28D 15/0233 165/104.26
2010/0108296 A1 * 5/2010 Moon et al. ..... F28D 15/04 165/104.26
2010/0157534 A1 * 6/2010 Oniki et al. ..... F28D 1/0391 361/700

FOREIGN PATENT DOCUMENTS

TW M451521 U1 4/2013
TW M501091 U 5/2015

* cited by examiner

*Primary Examiner* — Allen Flanigan
(74) *Attorney, Agent, or Firm* — C. G. Mersereau; Nikolai & Mersereau, P.A.

(57) ABSTRACT

A supporting structure for vapor chamber includes a first and a second plate member, a supporting member, and a working fluid. The first and the second plate member together define a chamber between them. The supporting member is located in the chamber, and has at least one base portion and a plurality of supporting portions, such that a plurality of passages is formed on the supporting member. The working fluid is filled in the chamber to flow through the passages. With these arrangements, the supporting structure for vapor chamber can overcome the problems of deformation caused by thermal expansion or pressure and uncontrollable bottom flatness as found in the prior art and can be manufactured at reduced labor and time cost while provides upgraded heat transfer efficiency.

10 Claims, 7 Drawing Sheets

SUPPORTING STRUCTURE FOR VAPOR CHAMBER

FIELD OF THE INVENTION

The present invention relates to a vapor chamber, and more specifically, to a supporting structure for vapor chamber that provides an enhanced supporting effect and can be produced at largely reduced manufacturing cost.

BACKGROUND OF THE INVENTION

As the computation performance of the currently available mobile devices, personal computers, severs, communication cabinets and other systems or devices has been largely upgraded, heat generated by computation units in these systems or devices is also largely increased. Therefore, heat dissipation units are required to dissipate the heat. Different heat dissipation units, such as heat sinks, heat pipes and vapor chambers, are widely used with cooling fans to enhance heat dissipation. Among others, vapor chambers are normally used with fans to enable forced heat dissipation from a large area. To avoid thermal resistance effect, the heat dissipation elements must be tightly attached to one another. Generally, the vapor chamber is a flat plate internally defining a chamber for vapor/liquid circulation to transfer the heat. Furthermore, the vapor chamber is internally provided with a plurality of supporting posts to support the chamber, lest the vapor chamber should expand or deform under heat or pressure.

The vapor chamber spreads the heat from one area to another area, and is provided with a plurality of supporting posts therein to avoid expansion or deformation under heat or pressure. However, it requires additional labor and time and increased manufacturing cost to provide the supporting posts. In the case copper cylinders externally combined with sintered rings are used as the supporting posts of the vapor chamber, the copper cylinders serve to support the chamber and the sintered rings enable back flow and circulation of the working fluid. In this case, the vapor chamber tends to have uncontrollable bottom flatness. Or, in the case copper cylinders with multiple grooves are used as the supporting posts of the vapor chamber, the copper cylinders serve to support the chamber and also enable back flow and circulation of the working fluid. In this case, the vapor chamber also tends to have uncontrollable bottom flatness. The vapor chamber can be otherwise internally etched to directly form supporting posts and vapor passages or flow channels on its inner wall surfaces. However, it requires more time to do so. Further, deeper etching requires longer time. Other processes, such as washing, drying and so on, also extend the manufacturing time.

In view that the conventional technique for solving the problem of a deformed vapor chamber also brings the problems of increased manufacturing costs and uncontrollable bottom flatness of the vapor chamber, it is desirable to work out a way to reduce the manufacturing cost.

SUMMARY OF THE INVENTION

To solve the above problems, a primary object of the present invention is to provide a supporting structure for vapor chamber that includes a first and a second plate member, a supporting member, and a working fluid. The first plate member has a first and a second side, whereas the second plate member has a third and a fourth side. The second plate member is assembled to the first plate member to define a chamber between the second side of the first plate member and the third side of the second plate member. The supporting member is located in the chamber, and has at least one base portion and a plurality of supporting portions, as well as a plurality of mutually communicable passages formed between the supporting portions. The working fluid is filled in the chamber to flow through the passages. With these arrangements, the vapor chamber supporting structure of the present invention can be formed by stamping to reduce labor and time cost while provides upgraded heat transfer efficiency, and can also overcome the problems of deformation under pressure and uncontrollable bottom flatness as found in the prior art vapor chambers.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
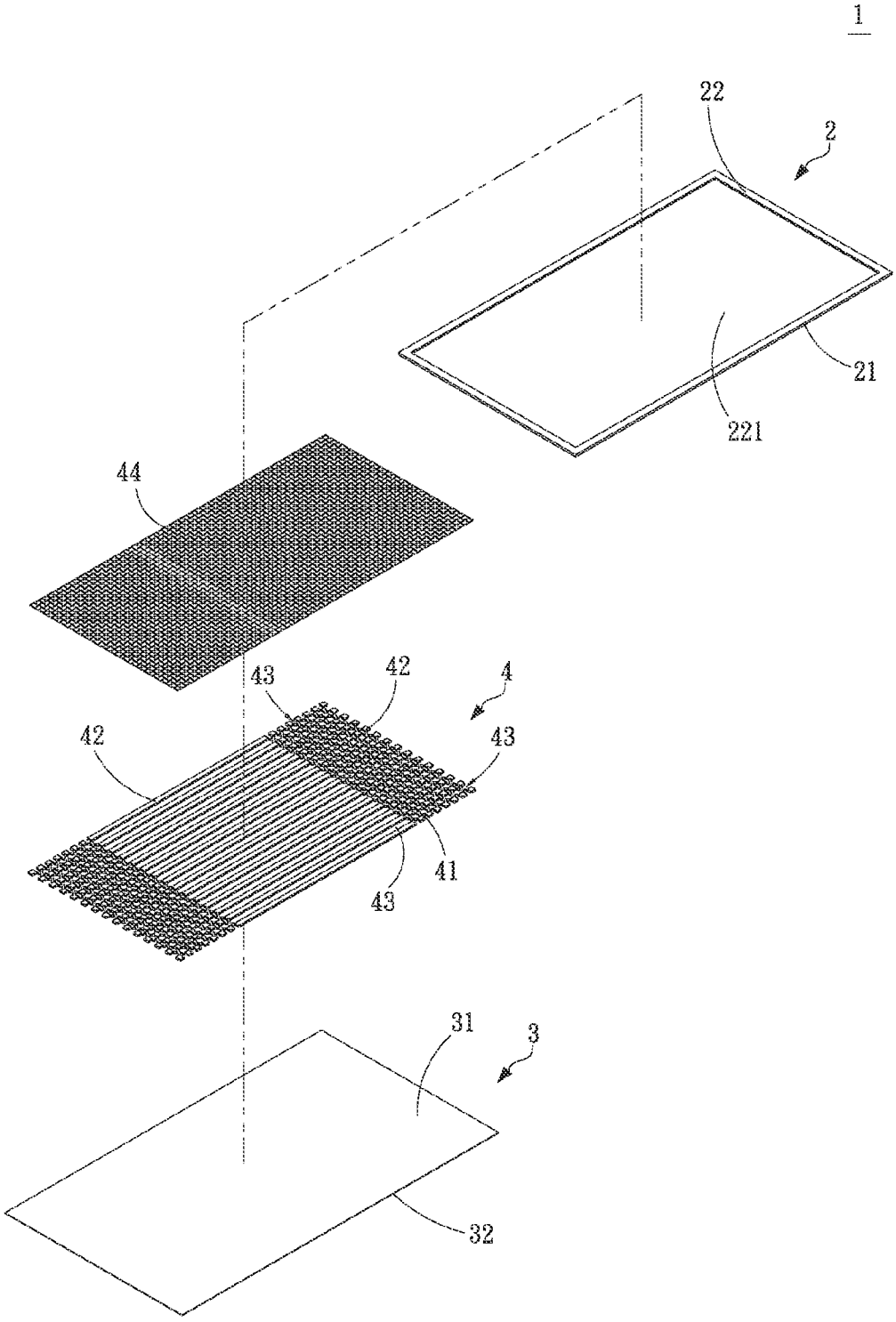
FIG. 1 is an exploded perspective view of a supporting structure for vapor chamber according to a first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
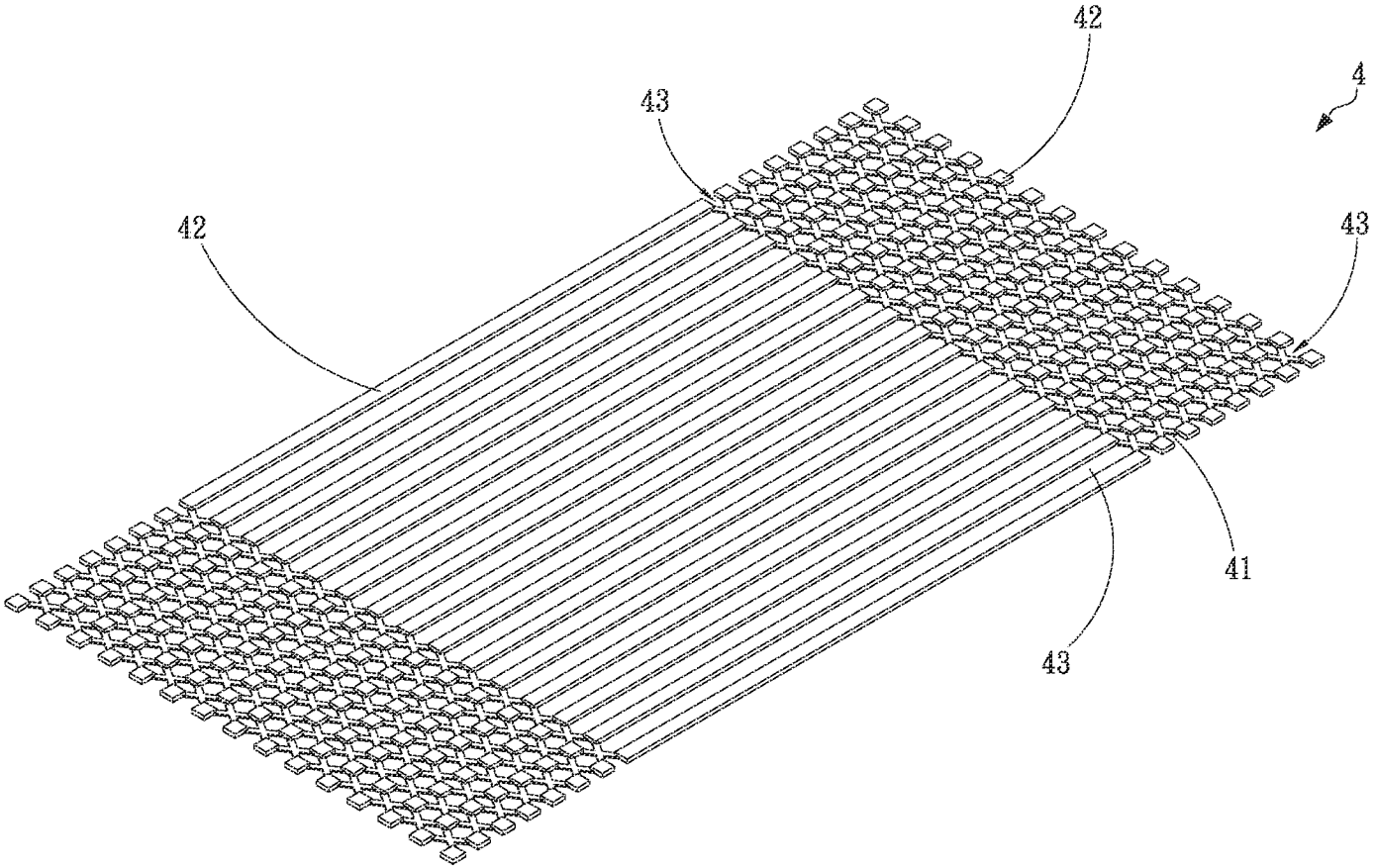
FIG. 2 is a perspective view of a supporting member included in the first preferred embodiment of the present invention.
Figure 3:
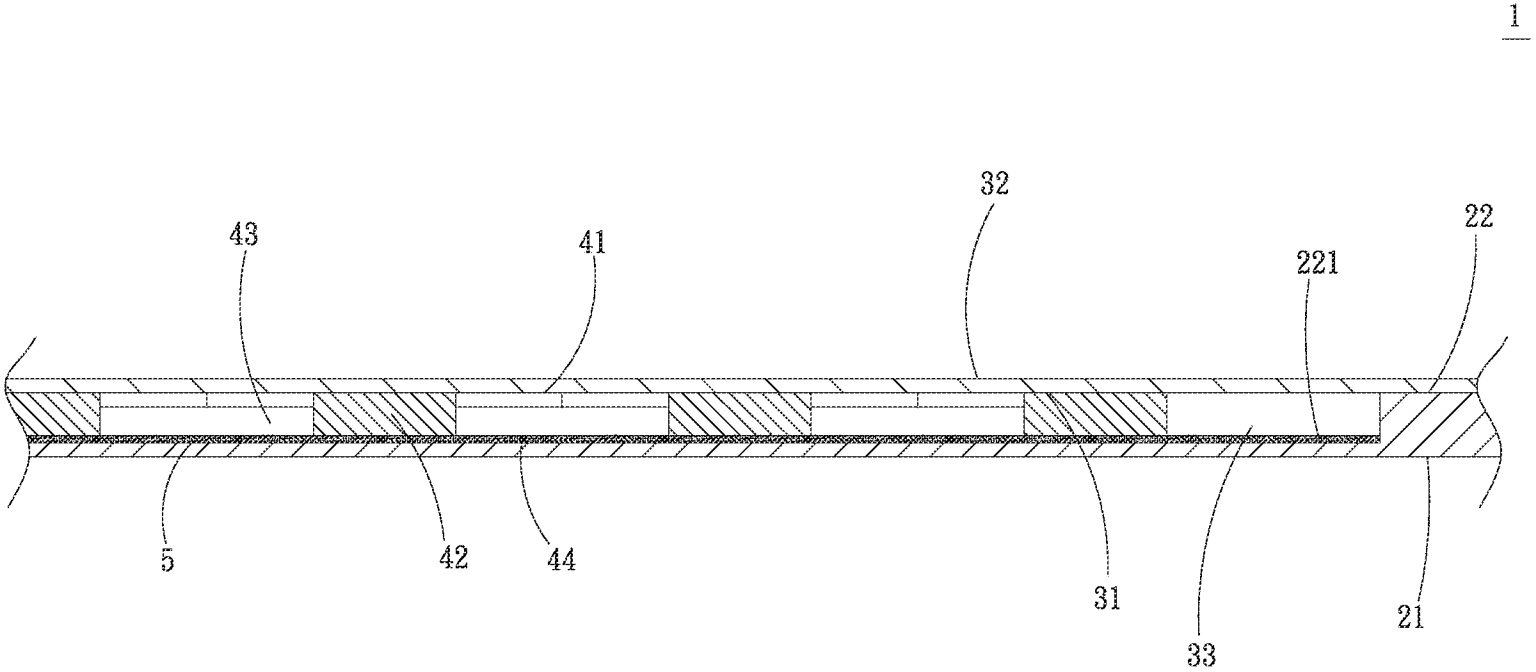
FIG. 3 is a fragmentary, assembled sectional view of FIG. 1.

Please refer to FIGS. 1 and 3, which are exploded perspective view and fragmentary, assembled sectional view, respectively, of a supporting structure for vapor chamber according to a first preferred embodiment of the present invention, and to FIG. 2, which is a perspective view of a supporting member 4 included in the first preferred embodiment of the present invention. For the purpose of conciseness, the present invention is also briefly referred to as the vapor chamber supporting structure and generally denoted by reference numeral 1 herein. As shown, the vapor chamber supporting structure 1 includes a first and a second plate member 2, 3, a supporting member 4, and a working fluid 5.

The first plate member 2 has a first side 21 and a second side 22 opposite to the first side 21, whereas the second plate member 3 has a third side 31 and a fourth side 32 opposite to the third side 31. The second plate member 3 is assembled to the first plate member 2 with the second side 22 of the first plate member 2 facing toward the third side 31 of the second plate member 3. On the second side 22 of the first plate member 2, there is defined a recess 221, such that a chamber 33 is formed between the second side 22 of the first plate member 2 and the third side 31 of the second plate member 3 when the second plate 3 is assembled to the first plate 2. The first and the second plate member 2, 3 are respectively made of a metal sheet, such as a copper sheet, an aluminum sheet, a copper foil-covered graphite sheet, or any other metal sheet with good heat conductivity. In the illustrated first preferred embodiment, the first and the second plate member 2, 3 are made of copper sheets without being limited thereto.

The supporting member 4 is located in the chamber 33 and correspondingly received in the recess 221. The supporting member 4 is formed by stamping, milling, casting, or other mechanical processing. In the illustrated first preferred embodiment, the supporting member 4 is integrally formed by stamping. The supporting member 4 has at least one base portion 41 and a plurality of supporting portions 42. The base portions 41 and the supporting portions 42 may have relative positions and configurations determined during stamping according to actual need in use. In the illustrated first preferred embodiment, the base portions 41 are respectively in the form of a mesh-like structure and located at two opposite ends of the supporting member 4 with one side thereof flatly attached to the third side 31 of the second plate member 3. As clearly shown in the drawings, some of the supporting portions 42 are substantially punctiform (i.e. point-like or dot-like in appearance), for example in the form of squares integrally extended from the base portions 41, while others are in the form of elongate strips provided on a central portion of the supporting member 4 with two ends connected to the base portions 41 located at two opposite ends of the supporting member 4. A plurality of passages 43 is formed between the square supporting portions 42 and between the elongate supporting portions 42 of the supporting member 4 to communicate with one another. The square supporting portions 42 located at two opposite ends of the supporting member 4 are arranged in arrays, such that the passages 43 formed therebetween are perpendicular to one another. In addition to be square in shape, the supporting portions 42 located at two opposite ends of the supporting member 4 can be otherwise rectangular, trapezoidal, round, elongated in shape, or in any other geometric shape. Furthermore, between the supporting portions 42 and the first plate member 2 there is provided a first wick structure 44. The first wick structure 44 is disposed in the recess 221 to locate between the first plate member 2 and the supporting member 4 with one side attached to the recess 221 and the other side attached to the supporting portions 42. After the second plate member 3 and the first plate member 2 are welded to each other along a joint between them, the working fluid 5 is filled in the chamber 33, and then the chamber 33 is evacuated and sealed to complete the vapor chamber supporting structure 1. The supporting member 4 is directly stamped to form the base portions 41 and the supporting portions 42. The base portions 41 and the supporting portions 42 in the chamber 33 can effectively support the first and the second plate member 2, 3, allowing the working fluid 5 to circulate in the chamber 33 via the first wick structure 44. With these arrangements, the vapor chamber supporting structure 1 formed by stamping can be manufactured at reduced labor and time cost, provide upgraded heat transfer efficiency, and overcome the problems of deformation under pressure and uncontrollable bottom flatness as found in the prior art vapor chambers.

Figure 4:
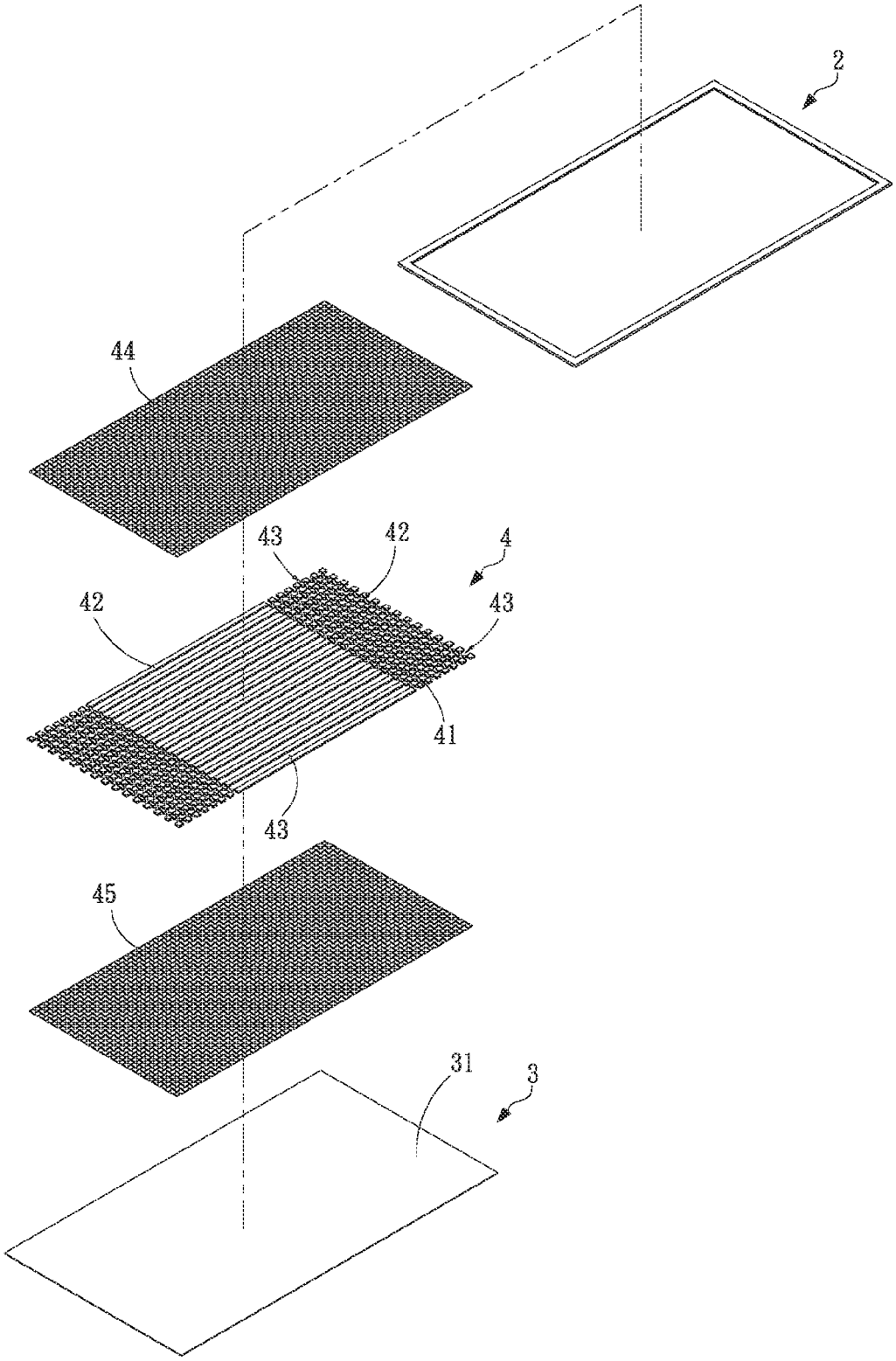
FIG. 4 is an exploded perspective view of the vapor chamber supporting structure according to a second preferred embodiment of the present invention.
Figure 5:
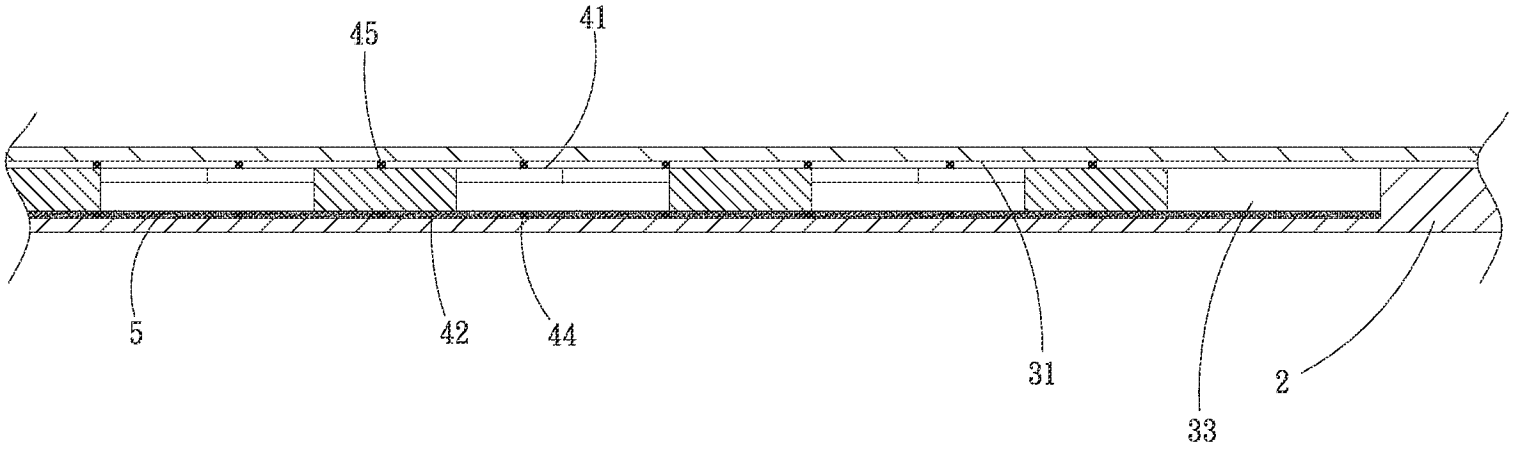
FIG. 5 is a fragmentary, assembled sectional view of FIG. 4.

Please refer to FIG. 4, which is an exploded perspective view of the vapor chamber supporting structure 1 according to a second preferred embodiment of the present invention, and to FIG. 5, which is a fragmentary, assembled sectional view of FIG. 4. As shown, the second preferred embodiment of the vapor chamber supporting structure 1 is generally structurally similar to the first preferred embodiment except that, in this second preferred embodiment, between the second plate member 3 and the supporting member 4 there is further provided a second wick structure 45. The second wick structure 45 has one side attached to the third side 31 of the second plate member 3 and the other side attached to the base portions 41. After the second plate member 3 and the first plate member 2 are welded to each other along the joint between them, the working fluid 5 is filled in the chamber 33, and then the chamber 33 is evacuated and sealed to complete the vapor chamber supporting structure 1. The supporting member 4 is directly stamped to form the base portions 41 and the supporting portions 42. The base portions 41 and the supporting portions 42 in the chamber 33 can effectively support the first and the second plate member 2, 3, allowing the working fluid 5 to circulate in the chamber 33 via the first and the second wick structure 44, 45. With these arrangements, the vapor chamber supporting structure 1 formed by stamping can be manufactured at reduced labor and time cost, provide upgraded heat transfer efficiency, and overcome the problems of deformation under pressure and uncontrollable bottom flatness as found in the prior art vapor chambers.

Figure 6:
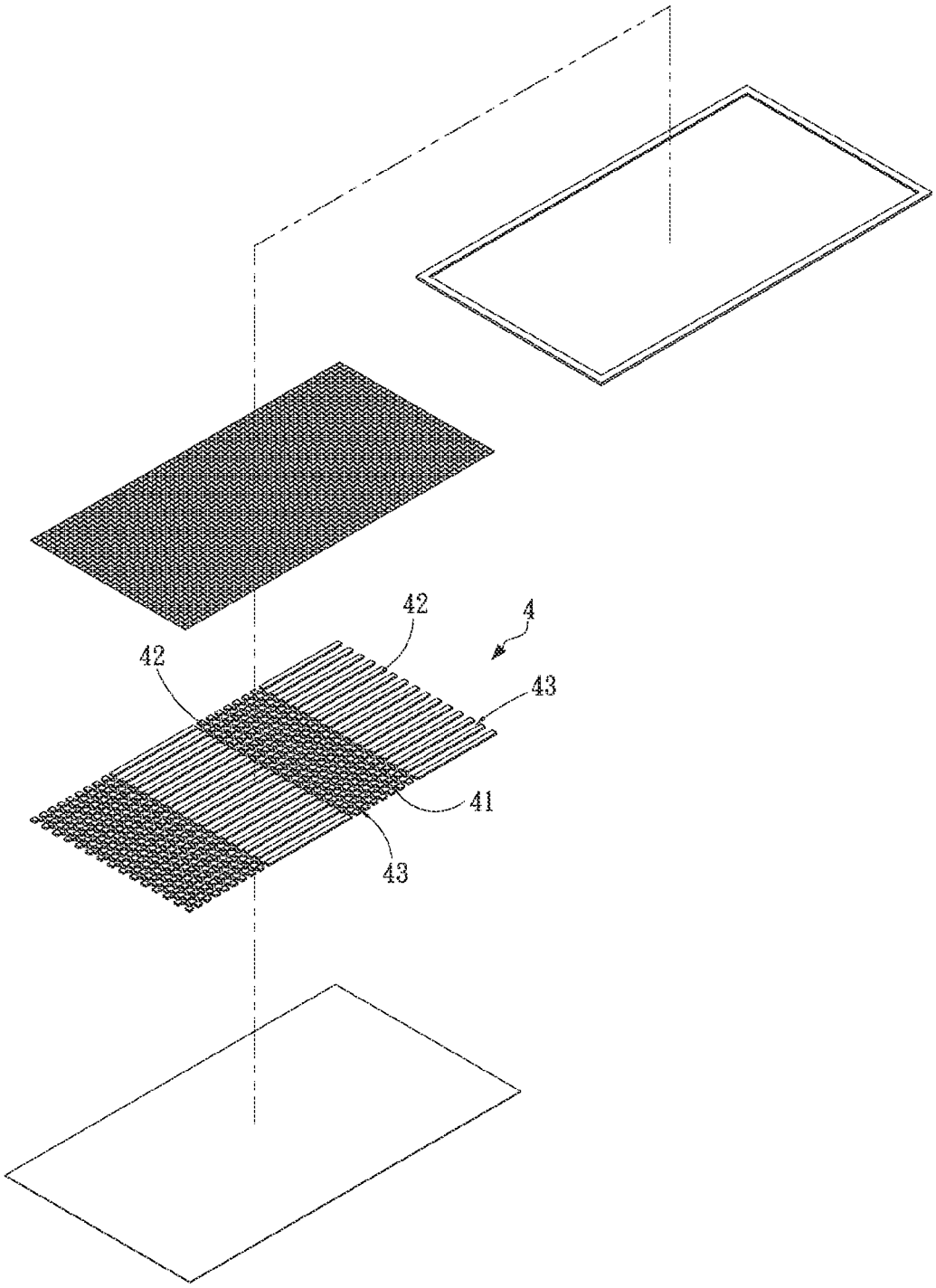
FIG. 6 is an exploded perspective view of the vapor chamber supporting structure according to a third preferred embodiment of the present invention.
Figure 7:
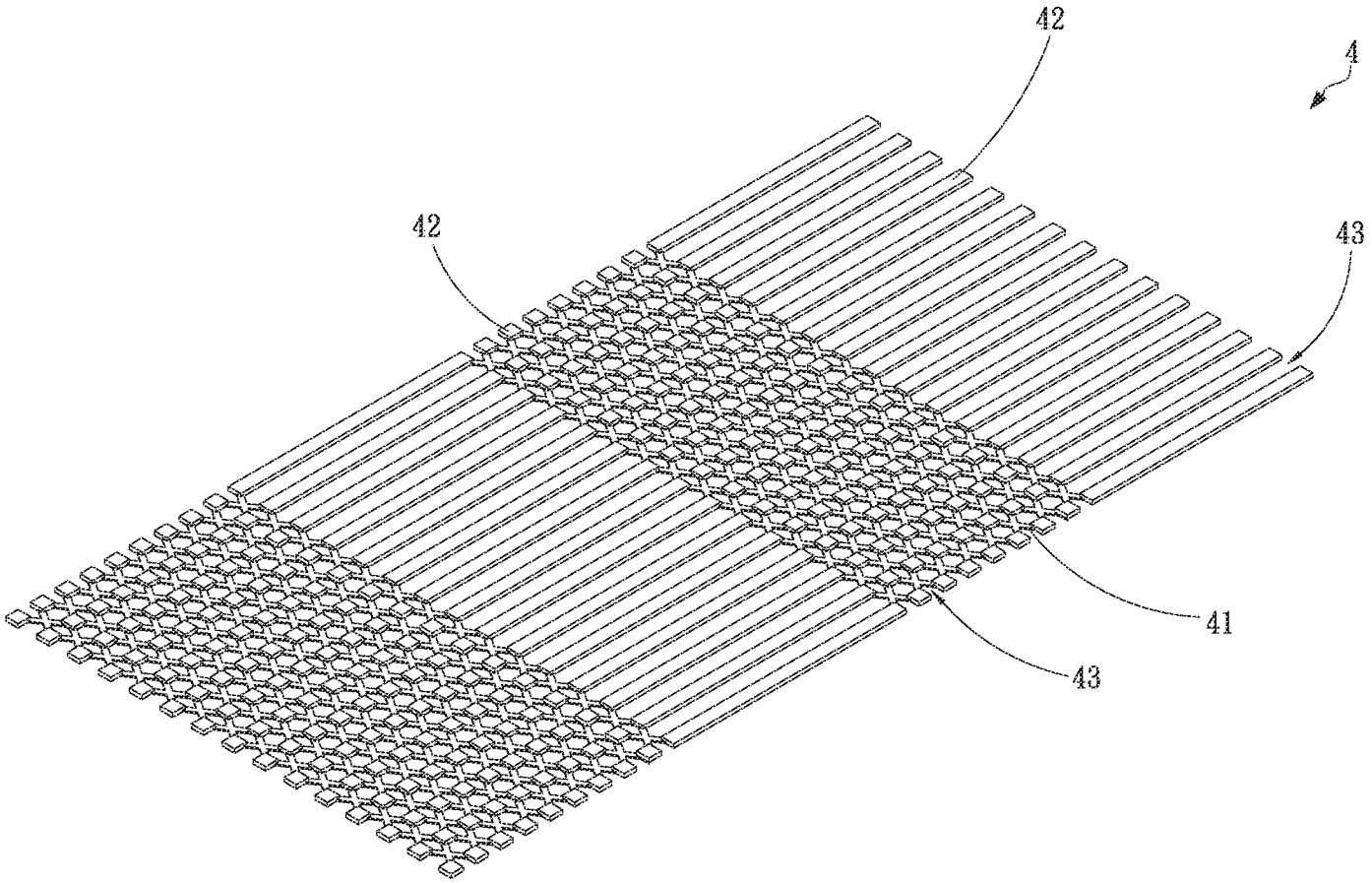
FIG. 7 is a perspective view of the supporting member included in the third preferred embodiment of the present invention.

Please refer to FIG. 6, which is an exploded perspective view of the vapor chamber supporting structure 1 according to a third preferred embodiment of the present invention, and to FIG. 7, which is a perspective view of the supporting member 4 included in the third preferred embodiment of the present invention. As shown, the third preferred embodiment of the vapor chamber supporting structure 1 is generally structurally similar to the first preferred embodiment except that, in this third preferred embodiment, the base portions 41 and the supporting portions 42 are differently arranged in position. In the illustrated third preferred embodiment, there are a first group of elongate supporting portions 42 extended from and connected to between inner ends of two base portions 41 and a second group of elongate supporting portions 42 further extended from an outer end of one of the two base portions 41. Again, a plurality of passages 43 is formed between the elongate supporting portions 42 and between the square supporting portions 42. It is understood the position arrangement of the base portions 41 and the supporting portions 42 is not necessarily limited to that shown in the third preferred embodiment but can be changed according to actual need in use.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat pipe with a support structure comprising:

a first plate member having a first side and an opposite second side; a second plate member having a third side and an opposite fourth side; and being assembled to the first plate member to thereby define a chamber for a working fluid between the second side of the first plate member and the third side of the second plate member; and a supporting member being located in the chamber, said supporting member comprising a sheet of material formed to define at least two regions, one of said regions defining substantially punctiform supporting portions disposed in a two dimensional array and being structurally interconnected to each other to define passages therebetween for working fluid;

another of said at least two regions disposed adjacent said one region defining substantially linear supporting portions extending in parallel and defining therebetween linearly extending passages for working fluid, said substantially linear supporting portions being connected at one end to said array of punctiform supporting members.

2. The heat pipe with a vapor chamber supporting structure as claimed in claim 1, wherein the second side of the first plate member has a recess formed thereon; and the supporting member being disposed in the recess with the supporting portions thereof extending towards the second side.

3. The heat pipe with a vapor chamber supporting structure as claimed in claim 2, further comprising a first wick structure provided between the supporting portions and the first plate member; the first wick structure being disposed in the recess to locate between the first plate member and the supporting member with one side of the first wick structure attached to the second side of the first plate member and another opposite side attached to the supporting portions.

4. The heat pipe with a vapor chamber supporting structure as claimed in claim 3, wherein the supporting member comprises a base portion, said base portion being attached to the third side of the second plate member.

5. The heat pipe with a vapor chamber supporting structure as claimed in claim 3, further comprising a second wick structure provided between the supporting member and the second plate member; and the second wick structure having one side attached to the third side of the second plate member and another opposite side attached to the base portion.

6. The heat pipe with a vapor chamber substantially punctiform supporting structure as claimed in claim 1, wherein the supporting portions have a configuration selected from the group consisting of a square, a rectangle, a trapezoid, a circle, an elongate strip, and any other geometric shape.

7. The heat pipe with a vapor chamber substantially punctiform supporting structure as claimed in claim 1, wherein the supporting portions are arranged in arrays, such that the passages are perpendicular to one another.

8. The heat pipe with a vapor chamber supporting structure as claimed in claim 1, wherein the first and the second plate member are respectively made of a metal sheet.

9. The heat pipe with a vapor chamber supporting structure as claimed in claim 6, wherein the first and the second plate member are respectively made of a material selected from the group consisting of a copper sheet, an aluminum sheet, a copper foil-covered graphite sheet, and any other sheet material with good heat conductivity.

10. The heat pipe with a vapor chamber supporting structure as claimed in claim 1, further comprising a working fluid filled in the chamber to flow through the passages.

* * * * *